US006511201B1

(12) United States Patent
Elrod

(10) Patent No.: US 6,511,201 B1
(45) Date of Patent: Jan. 28, 2003

(54) AIR GUN WITH INTEGRAL AIR POWERED LIGHT

(76) Inventor: Dale K Elrod, 710 Forest Lair, Tallahassee, FL (US) 32312

( * ) Notice: Subject to any disclaimer, the term of this patent is extended or adjusted under 35 U.S.C. 154(b) by 0 days.

(21) Appl. No.: 10/002,721

(22) Filed: Dec. 5, 2001

(51) Int. Cl.[7] ..... B25B 23/18

(52) U.S. Cl. ..... 362/119; 362/109; 362/96; 362/192; 124/56; 81/57.14; 81/54; 173/93.5; 173/93; 173/176

(58) Field of Search ..... 362/119, 109, 362/112, 110, 96, 192; 124/56; 81/57.14, 54, 467, 429, 472, 473, 474, 476, 63; 173/93.5, 93, 176, 178; 239/390, 391, 396, 289

(56) References Cited

U.S. PATENT DOCUMENTS 4,291,839 A * 9/1981 Brett ..... 239/289
5,267,129 A * 11/1993 Anderson ..... 362/96
5,412,546 A * 5/1995 Huang ..... 362/119
5,873,647 A * 2/1999 Kurtz et al. ..... 362/96
6,142,387 A * 11/2000 Jou ..... 239/390

* cited by examiner

*Primary Examiner*—Sandra O'Shea
*Assistant Examiner*—Ronald E. DelGizzi
(74) *Attorney, Agent, or Firm*—Kyle S. Brant

(57) ABSTRACT

An air blast tool having an air nozzle and integrated air powered electrical generator with electric lamp is disclosed. Compressed air supplied to the air blast tool is also supplied to the air powered generator within the tool to produce electricity. Light produced by the electric lamp is directed in the same direction as the air blast nozzle to enable the user to readily see machined surfaces and the like.

12 Claims, 8 Drawing Sheets

AIR GUN WITH INTEGRAL AIR POWERED LIGHT

FIELD OF THE INVENTION

The present invention relates in general to pneumatically powered hand tools and more specifically to an air blast hand tool including an air powered generator that produces an electrical signal supplied to a source of illumination such as an incandescent bulb

BACKGROUND OF THE INVENTION

Lathes, mills, and other similar material removal machining devices are typically used to produce custom machined parts. Oftentimes, the machinist operating such machinery desires to remove the machined away metal chips from the work area to perform visual inspection of the machined surfaces. Removal of the machined chips by hand is dangerous due to the sharp edges of the chips. Common techniques for removing machined chips from the work piece include hand held brushes and air blast tools. For the machinist, an air blast tool is perhaps the most convenient and most commonly used tool for chip removal. After the chips are removed from the work piece the machinist typically desires to visually inspect the machined surfaces to evaluate the machining operation and its quality and progress. A hand held "drop light" or a flashlight are currently the best mechanisms for illuminating the work piece in its mounted position within the machining station. A combination air blast tool having a light integrated into the air blast tool would simplify the machinists work by providing a light source that illuminates the machined surfaces during and after chip removal. Further, since a source of pressurized air is.already present where an air blast tool is in use, a light producing device that derives its power from a miniature pneumatically driven electric generator within the air blast tool improves efficiency of motion for the machinist while eliminating the power cord necessary for supplying power to a hand held drop light.

SUMMARY OF THE INVENTION

An air blast tool having an integral light source, according to one aspect of the present invention, comprises a body having an inlet aperture, a first outlet aperture and a second outlet aperture and wherein said first outlet aperture and said second outlet aperture are in fluid communication with said inlet aperture, first valve means partially disposed within said first outlet aperture for controlling air flow therethrough, an air powered electrical generator having a rotor and a stator, said air powered generator being disposed within said second outlet aperture, said air powered electrical generator producing an electrical signal in response to pressurized air supplied from said inlet aperture to said second outlet aperture, an electric light attached to said body and receiving said electrical signal to illuminate said electrical light, and air nozzle means attached to said body and disposed over said first outlet aperture.

One object of the present invention is to provide an improved air blast hand tool for use with machining or woodworking operations.

Another object of the present invention is to provide an air blast tool with an integrated light that is powered by an air driven electrical generator incorporated into the air blast tool.

Yet another object of the present invention is to eliminate the need for electrical power cords and drop lights in the area of a machining operation, yet take advantage of the presence of an air blast tool necessary to remove metal chips or sawdust.

These and other objects of the present invention will become more apparent from the following description of the preferred embodiment.

DESCRIPTION OF THE PREFERRED EMBODIMENT

Figure 1:
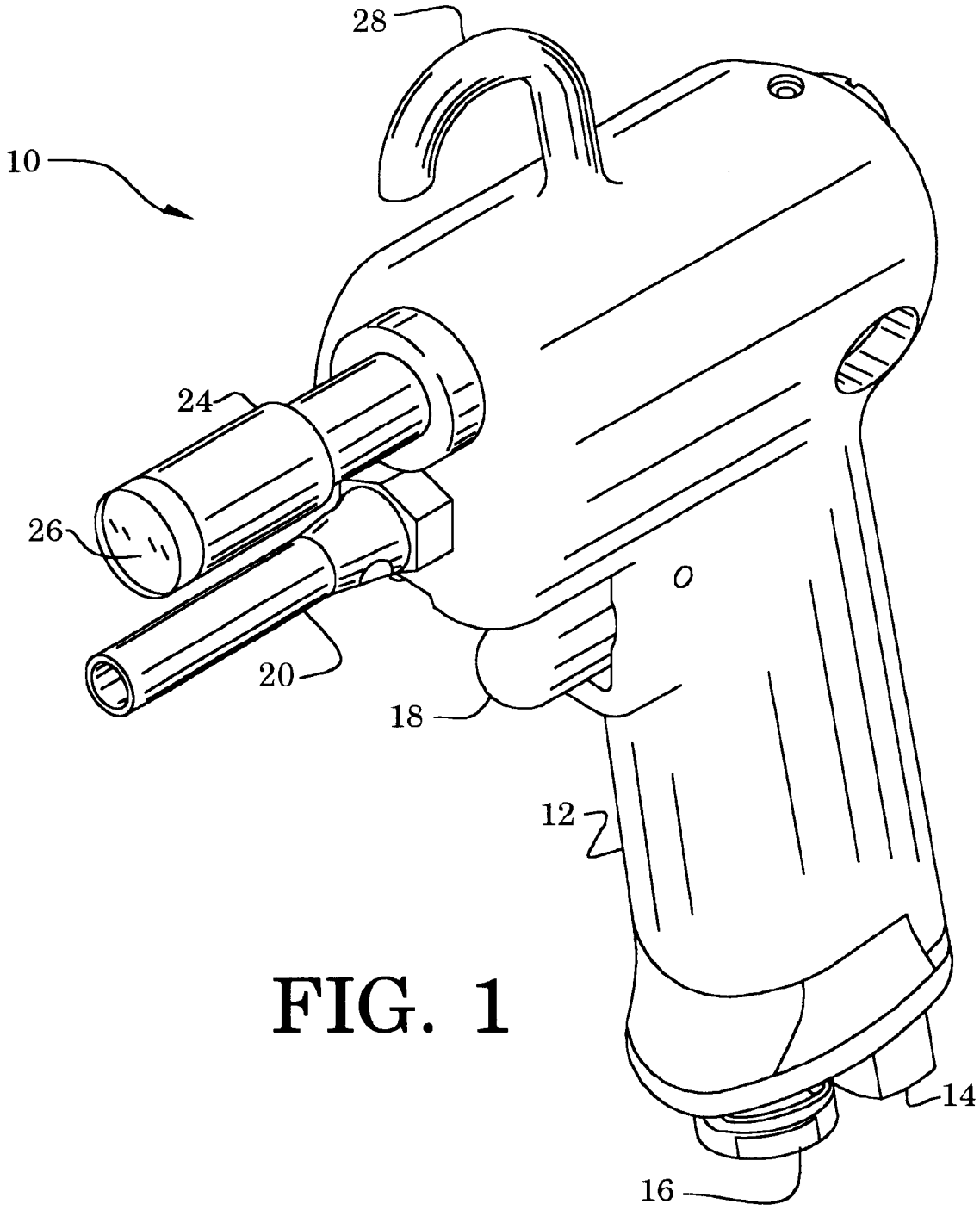
FIG. 1 is a perspective view of an air gun with integral air powered light according to one aspect of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
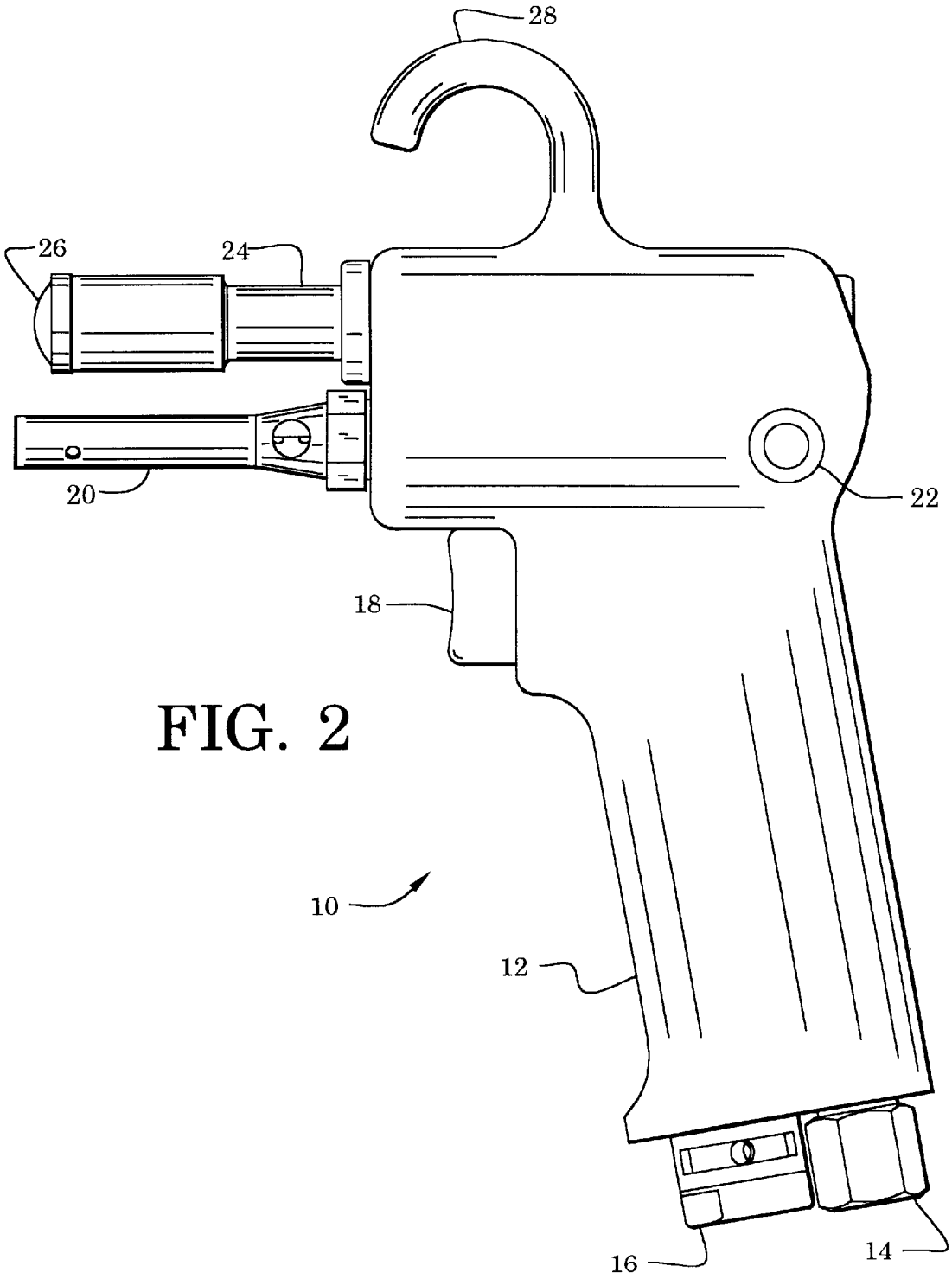
FIG. 2 is a side elevational view of the air gun with integral air powered light of FIG. 1.

Referring now to FIGS. 1 and 2, a perspective view and a front elevational view of an air gun with integral air powered light 10, according to the present invention, are shown. Air gun 10 includes a body 12 made from metal, plastic or other suitable material. Fitting 14 is rotatably inserted into a threaded aperture in body 12 and secured thereto. A source of compressed air (not shown) is attached to fitting 14. A directional exhaust assembly 16 is rotationally inserted into a threaded aperture in body 12 (discussed in more detail below). Trigger 18 is movably mounted to body 12 and is depressable by the user to engage a valve (see FIG. 3) within body 12 to enable the internal flow of compressed air from fitting 14 to air nozzle 20 within body 12. Valve 22, attached to body 12, is positionable to enable and disable the delivery of compressed air to an air powered electrical generator (shown in more detail below) within body 12. A source of light, such as an incandescent bulb or suitable substitute, is disposed within light tube 24. A lens 26 is mounted on the distal end of tube 24. Lens 26 focuses light emanating from within tube 24 onto objects aligned with tube 24. Hook portion 28 extends upwards and turns back towards body 12 to provide a convenient mechanism for removably hanging device 10 on a suitable mounting location in the users workplace.

Operationally speaking, compressed air is delivered to fitting 14 so that apertures (also referred to as fluid passages or cavities) within body 12 are filled with compressed air. Trigger 18 activates a valve (discussed below and shown in FIG. 3 ) within body 12 to deliver compressed air to air nozzle 20. Valve 22 enables and disables the flow of compressed air to an air powered electric generator (see below) within body 12 that produces electricity for powering the lamp within tube 24.

Figure 3:
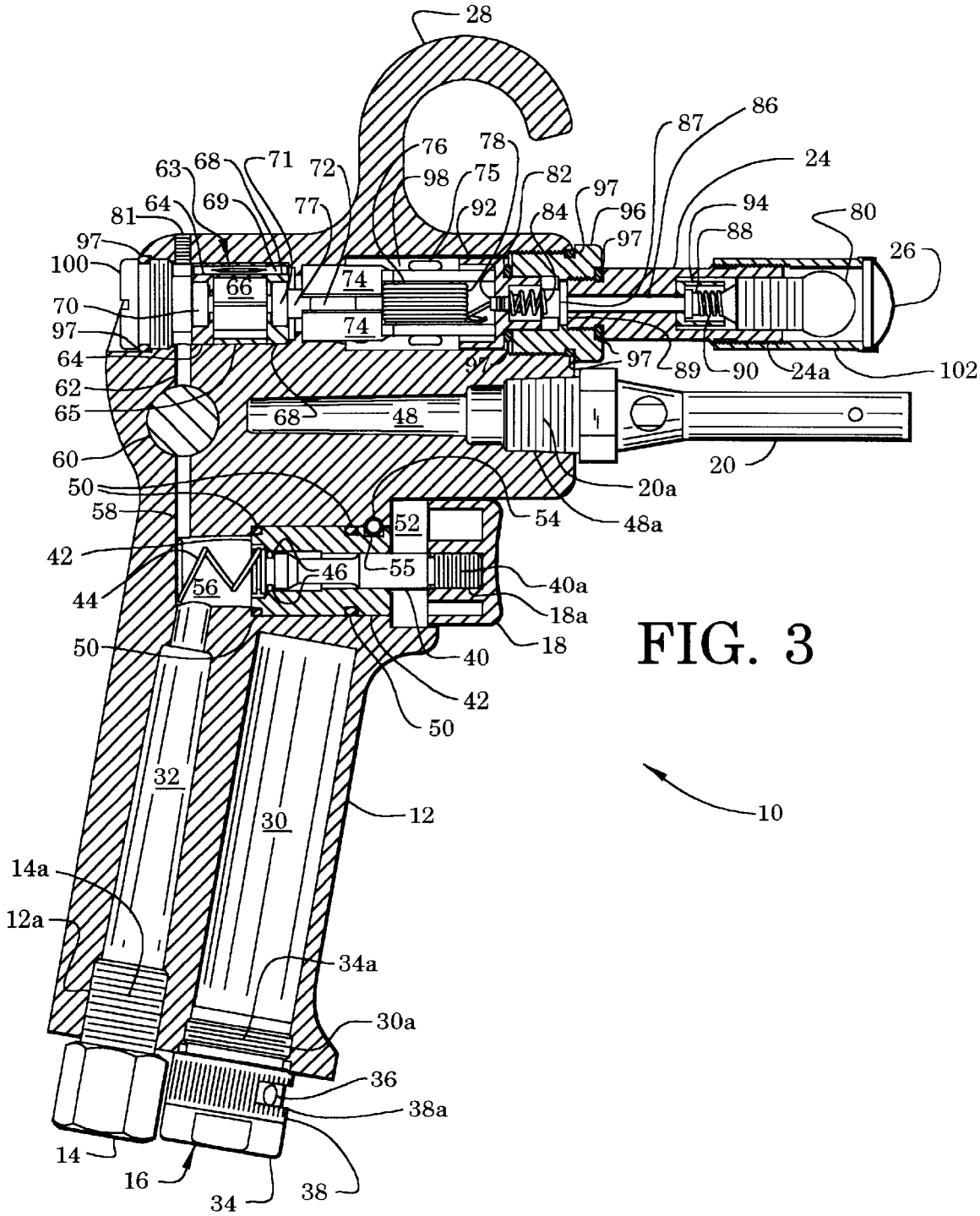
FIG. 3 is a. cross-sectional view of the air gun with integral air powered light of FIG. 1.

Referring now to FIG. 3, a partial cross-section of the air gun with integral air powered light 10 is shown. Body 12 includes apertures shown at 30 and 32. Hollow compressed air fitting 14 includes a threaded portion 14*a* that mates with a threaded portion 12*a* of body 12. Standard tapered threads are formed at 12*a* and 14*a* to provide an air tight seal. Directional exhaust 16 is comprised of a threaded fitting 34 having a fluid channel 36 therethrough enabling compressed air in aperture 30 to escape to the atmosphere through channel 36. An exhaust deflector ring 38 is rotatably disposed over fitting 34. Ring 38, includes a slot 38*a* formed therein so that compressed air escaping aperture 30 via channel 36 may be redirected in any direction desired by the user of device 10 by rotating ring 38 about fitting 34. Fitting 34 includes a threaded portion 34*a* that mates with corresponding threads 30*a* formed in aperture 30.

Trigger 18 is attached to valve stem 40 via threaded portion 18*a* of trigger 18 and threaded portion 40*a* of valve stem 40. Valve body 42 receives valve stem 40 therein. Trigger 18, when depressed, forces valve stem 40 toward spring 44 and compresses spring 44. When valve stem 40 is moved toward spring 44, compressed air in apertures 32 and 56 passes over valve stem 40 and into the interior of valve body 42 when o-ring seal 46 is separated from contact with valve body 42. Apertures 32 and 56 are in fluid communication with each other. An aperture in valve body 42 (see FIGS. 13–16) enables compressed air within valve body 42 to flow into aperture 48 and out through nozzle 20. O-ring seals 50 prevent compressed air in aperture 32 from escaping past valve body 42 through trigger aperture 52. Roll pin 54 is inserted into aperture 55 and through body 12 transverse to valve stem 40 through a cutout in valve body 42 to retain valve body 42 in position with respect to body 12. Nozzle 20 is shown having a threaded portion 20*a* that mates with corresponding threads 48*a* formed within aperture 48.

Aperture 32 is in fluid communication with apertures 56 and 58. Compressed air travels through aperture 58 and encounters motor valve 60. Motor valve 60 enables and disables the flow of compressed air in aperture 58 to aperture 62. Aperture 62 provides a conduit through which compressed air is delivered to electrical generator 63. Set screw or plug 81 provides an air seal of aperture 62. To machine aperture 62, a hole is drilled vertically downward into body 12 and aperture 62 is sealed by set screw 81. Generator 63 is an air powered electricity generating device discussed in more detail below. See FIGS. 4–5 and the discussion below for more detail on the configuration and operation of motor valve 60. Compressed air in aperture 62 travels through end plate 64 to engage rotor 66. Compressed air flowing over rotor 66 exits through end plate 68 and travels though slot 112 in end plate 68 (see FIG. 9) into aperture 104 (see FIG. 7) and on to aperture 30, the exhaust aperture, and out into the atmosphere. Bearings 70 and 71 support rotor 66 and enable rotor 66 to rotate freely. Rotor housing 65 surrounds rotor 66. Magnet spacer 77 is mounted on rotor 66. Magnet 72 is attached to one end of rotor 66 and rotates between stator poles 74. Stator poles 74 are attached to bobbin 76 via staked or riveted stator core 75. Bobbin 76 includes a multitude of wire windings 78 wrapped thereabout. Magnetic flux field deviations generated by the rotation of magnet 72 are routed through stator poles 74 to induce a current to flow in windings 78. Windings 78 are electrically connected to rivet 82 Contact spring 84 is attached to rivet 82 and provides a path for electricity to travel to insulated conductor 86. Conductor 86 is electrically connected to disk shaped metal contact 87 that physically contacts spring 84. Metal spring 90 is attached to metal rivet 88 and conductor 86 is electrically attached to rivet 88. Insulator 89 centers or fixes contact 87 in position and encourages physical contact between contact 87 and spring 84. Incandescent bulb 80 receives an electrical signal from contact spring 90, and metal tube 24 provides a return path for electricity to windings 78. Insulator cap 92 is attached with adhesives or the like over stator poles 74. Rivet 82 is attached to plastic insulator cap 92 via adhesives or molded integrally therewith. Rivet or contact lug 88 is supported in position and surrounded by insulator 94. Threaded adapter 96 mates with threads in body 12 to secure insulator cap 92 and stator poles 74 in a fixed position within aperture 98. Threaded adapter plug 100 mates with threads in body 12 and secures rotor 66 and magnet 72 in position as shown within aperture 98. Also shown are lens 26 mounted to adapter 102 which matingly engages external threads 24*a* of tube 24, groove pin 69 that attaches end plates 64 and 68 to one another, and hook 28 of body 12. Various o-ring fluid seals 97 are also shown in FIG. 3.

Figure 4:
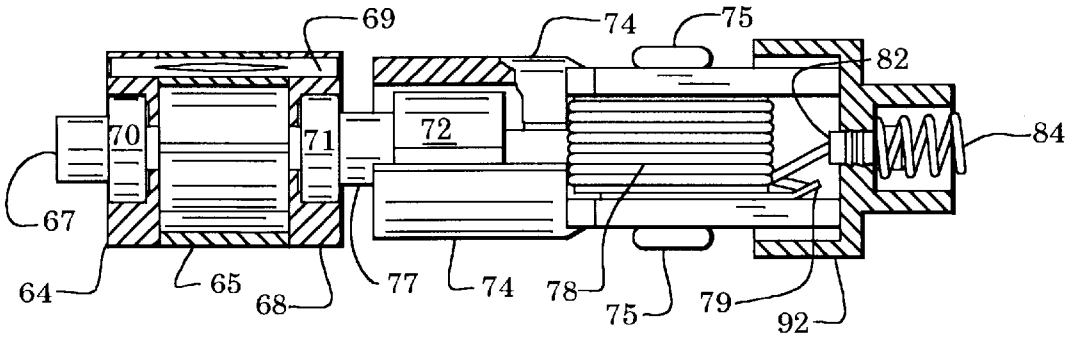
FIG. 4 is cross-sectional view of the air powered generator.
Figure 5:
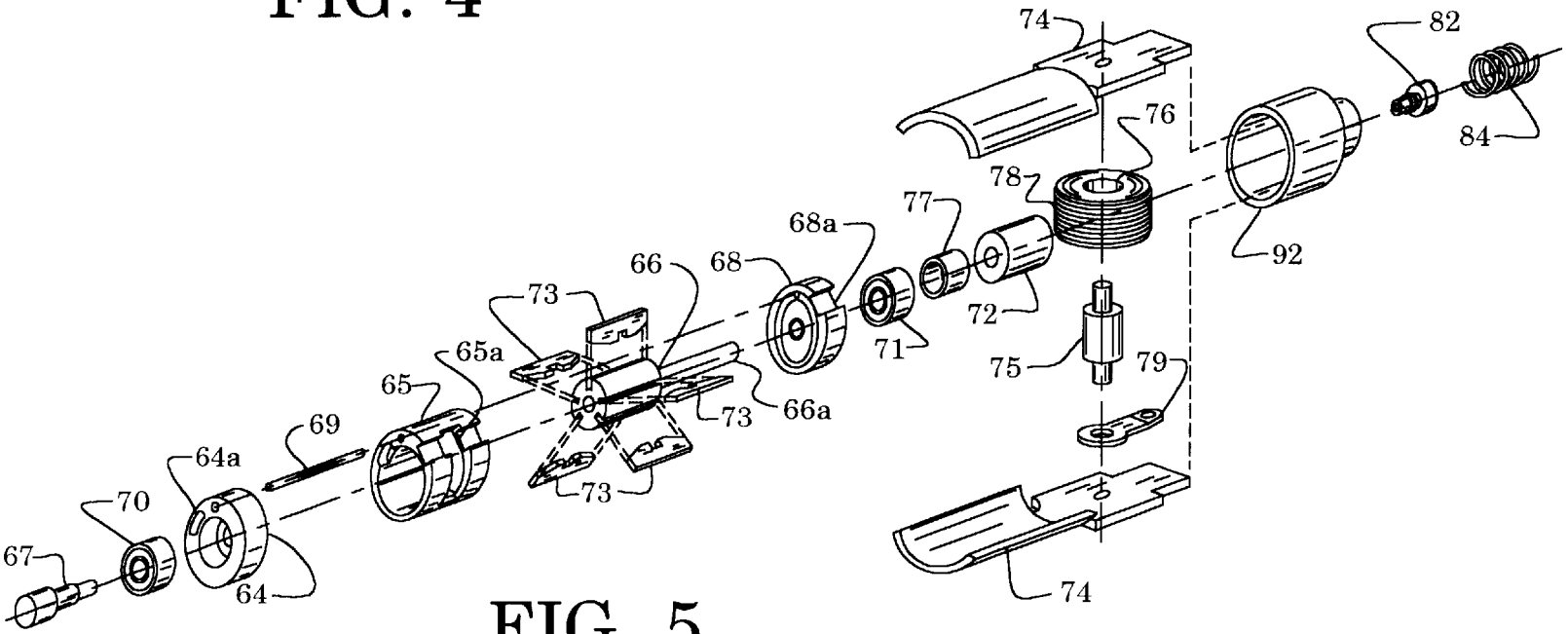
FIG. 5 is an exploded perspective view of the air powered generator.

Referring now to FIGS. 4 and 5, an enlarged cross-sectional view of the air powered generator 63 and an exploded view of the generator 63 are shown. Rotor shaft 67 is inserted through bearing 70 and is press fit into a mating hole in rotor 66. Bearing 70 is mounted in end plate 64 and bearing 71 is mounted in end plate 68. Groove pin 69 is inserted through a hole in rotor housing 65 and pressed into apertures in end plates 64 and 68. Air vanes 73 are fixedly attached into slots in rotor 66. Spacer 77 is disposed on the rotor shaft 66*a* and provides a predetermined mounting location on shaft 66*a* for magnet 72. Bobbin 76 and windings 78 are disposed between stator poles 74. Stator core 75 is inserted through bobbin 76 and staked or riveted to stator poles 74. Insulator cap 92 receives and is attached to stator poles 74 with adhesive or the like. Electrical contact rivet 82 is attached to insulator cap 92 and contact spring 84 attaches to rivet 82. Windings 78 are electrically connected to contact rivet 82 and solder lug 79. Solder lug 79 makes electrical contact with body 12 via stator poles 74 to provide a return path for electricity generated by motor*generator 63.

Operationally, compressed air enters orifice 64*a* in end plate 64, travels within rotor housing 65, over vanes 73, through orifice 65*a* in rotor housing 65 and along channel 68a in end plate 68. The force of the compressed air on vanes 73 causes rotor 66 to rotate. Magnet 72, fixedly attached to rotor 66, rotates accordingly. Magnet 72 varies in magnetic intensity rotationally around the lateral surface thereof so that rotation of magnet 72 causes a varying magnetic field to impinge upon stator poles 74. A varying magnetic field impinging upon stator poles 74 induces a current to flow in coil or windings 78.

Figure 6:
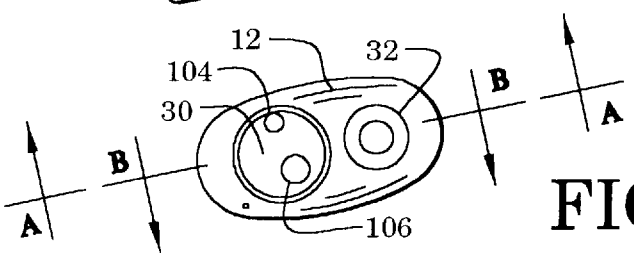
FIG. 6 is a bottom view of the body portion.

Referring now to FIG. 6, a bottom view of the handle portion of body 12 is shown. From this view, it is more apparent that aperture 30 is in fluid communication with apertures or fluid channels 104 and 106. Also shown in FIG. 6 is aperture or fluid channel 32. Aperture 104 provides a fluid flow path for exhaust of pressurized air from generator 63. Aperture 106 is a channel or fluid passage through which compressed air is delivered to air blast nozzle 20 from aperture 52. A fluid path from compressed air supply aperture 32 to aperture 52 is established through valve body 42 when valve stem 40 is actuated toward spring 44 (see FIGS. 3 and 13–14).

Figure 8:
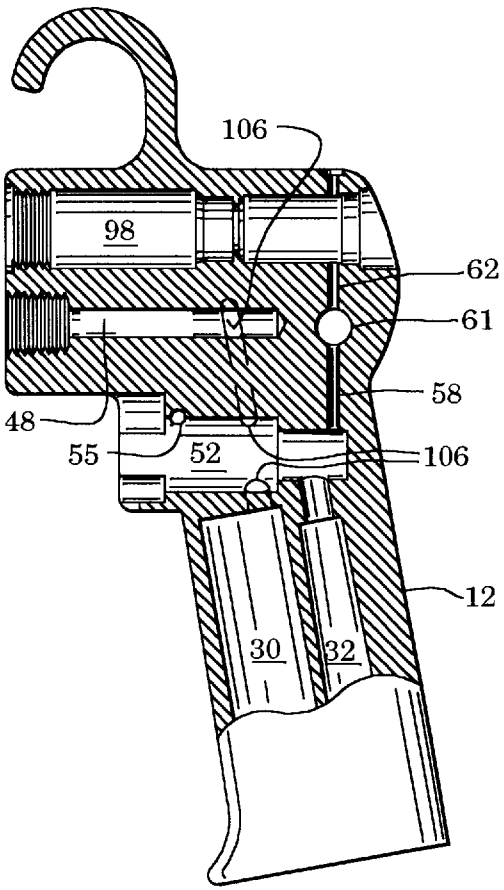
FIG. 8 is a cross-sectional view of the body looking in the direction of the arrows labeled B—B in FIG. 6.
Figure 7:
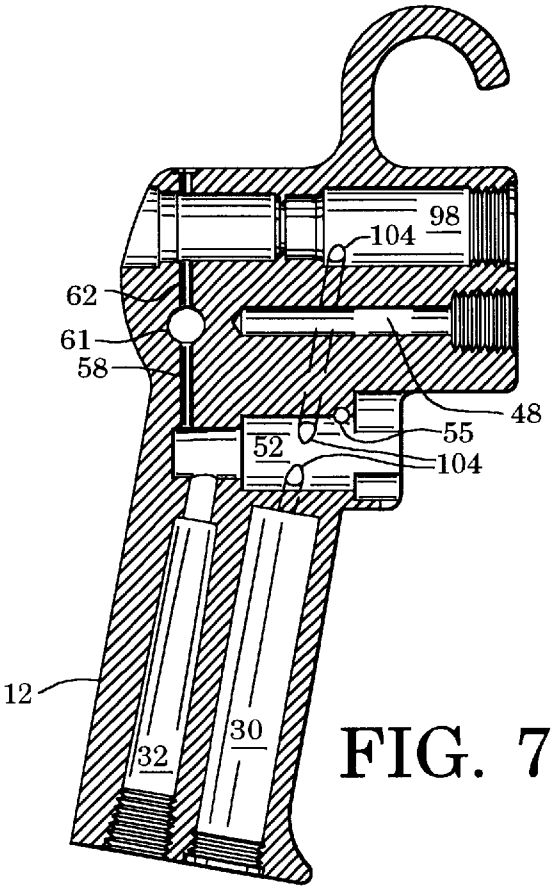
FIG. 7 is a cross-sectional view of the body looking in the direction of the arrows labeled A—A in FIG. 6.

Referring now to FIGS. 7 and 8, cross-sectional views of the body 12 are shown. FIG. 7 is a cross-sectional view looking in the direction of the arrows labeled A—A in FIG. 6, and FIG. 8 is a cross-sectional view looking in the direction of the arrows labeled B—B in FIG. 6. Various fluid channels or apertures wherein compressed air flows within body 12 are shown in more detail in FIGS. 7 and 8. Compressed air is supplied to aperture 32 Which is in fluid communication with apertures 52 and 58. Compressed air that encourages motor-generator 63 to rotate is supplied via apertures 58, 61 and 62 to aperture 98. Fluid passage or aperture 104 provides a channel for compressed air to pass from aperture 98, through aperture 52, and on to exhaust aperture 30. Similarly, aperture 106 provides a fluid passage for compressed air to flow between aperture 52 and aperture 48. Valve body 42 (see FIG. 3) prevents compressed air flow between apertures 52 and 30 yet allows air to flow between aperture 30 and aperture 98 via aperture 104. Also shown are roll pin slot or aperture 55 into which roll pin 54 is inserted and aperture or through hole 61 wherein motor valve 60 (see FIGS. 3 and 17) is received.

Body 12 is preferably cast from aluminum or other suitable metal and then machined on various- surfaces to establish desired dimensional tolerances with internal components and to form various threads therein.

Figure 9:
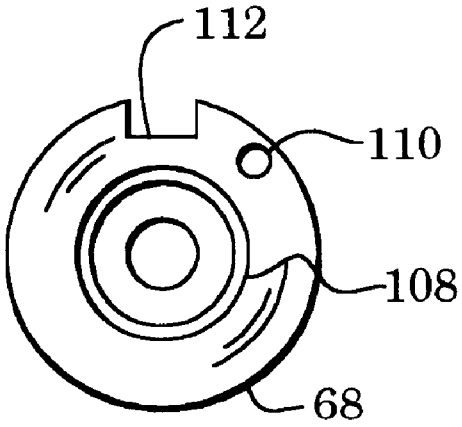
FIG. 9 is a front elevational view of end plate 68.
Figure 10:
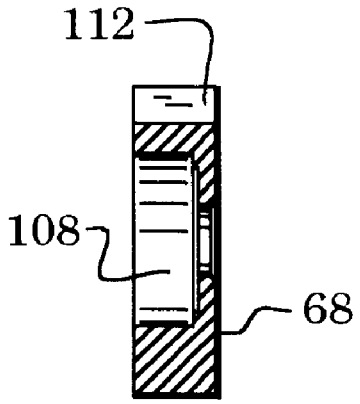
FIG. 10 is a cross-sectional view of end plate 68.

Referring now to FIGS. 9 and 10, end plate 68 is shown in a front elevational view and a cross-sectional view. End plate 68 includes bore 108 for receiving bearing 71 (see FIG. 5) therein. Hole 110 receives pin 69 (FIG. 5) to maintain rotational alignment of end plate 68 with respect to end plate 64 (FIG. 5) and rotor housing 65 (FIG. 5). Slot 112 provides a channel for compressed air to flow past end plate 68 and into aperture 98 and on through aperture 104 to exhaust aperture 30 (see FIG. 7).

Figure 11:
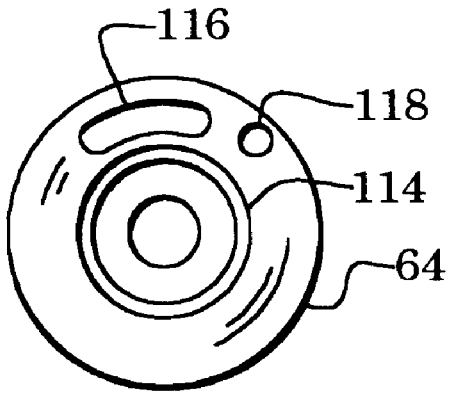
FIG. 11 is a front elevational view of end plate 64.
Figure 12:
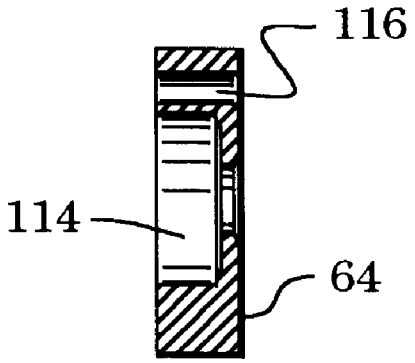
FIG. 12 is a cross-sectional view of end plate 64.

Referring now to FIGS. 11 and 12, a front elevational view and a cross-sectional view of end plate 64 are shown. Bore 114 receives bearing 70 (FIG. 5) therein. Compressed air from aperture 62 (FIGS. 7) flows through slot 116 and into the rotor housing 65 (FIG. 3) to engage vanes 73 of rotor 66 (see FIG. 5) and exits the rotor area via slot 112 in end plate 68 (FIG. 9). Hole 118 receives pin 69 (FIG. 5). It should be apparent that slot 116 and slot 112 are not in alignment due to the location of hole 110 (FIG. 9) and hole 118 so that an offset angle of about ninety degrees is established therebetween. The non-alignment of slot 116 and slot 112 establishes a non-direct path so that air must flow over rotor 66 (FIG. 5) and vanes 73 (FIG. 5) and thereby encourages rotor 66 to rotate.

Figure 15:
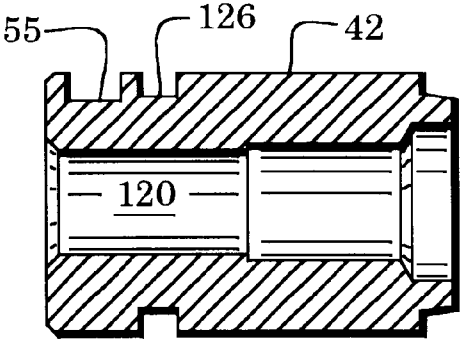
FIG. 15 is a cross-sectional view of trigger valve body 42 looking in the direction of arrows A—A in FIG. 14.
Figure 16:
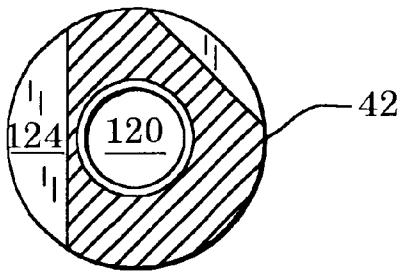
FIG. 16 is a cross-sectional view of trigger valve body 42 looking in the direction of-the arrows labeled A—A in FIG. 13.
Figure 14:
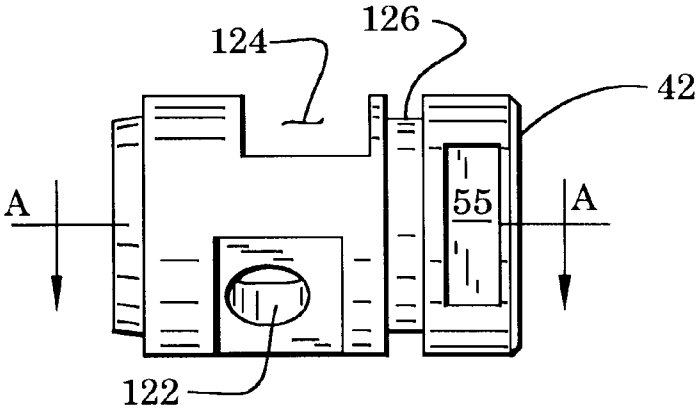
FIG. 14 is a plan view of trigger valve body 42.
Figure 13:
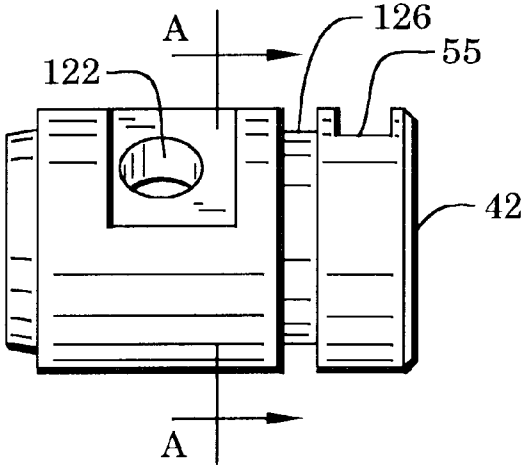
FIG. 13 is a side elevational view of trigger valve body 42.

Referring now to FIGS. 13–16, trigger valve body 42 is shown in detail. FIG. 13 is a front elevational view, FIG. 14 is a plan view, FIG. 15 is a cross-sectional view looking in the direction of the arrows labeled A—A of FIG. 14, and FIG. 16 is a cross-sectional view looking in the direction of the arrows labeled A—A in FIG. 13. Slot 55 engages roll pin 54 (FIG. 3) to secure valve body 42 in position within aperture 52 (FIG. 7). When trigger 18 (FIG. 3) is depressed inward, compressed air in aperture 32 (FIG. 3) is supplied to the interior 120 of valve body 42. Compressed air from interior aperture 120 flows out through aperture 122 through aperture 106 (FIG. 8) and into aperture 48 (FIG. 8) and from there through air nozzle 20 (FIG. 3). Cutout portion 124 establishes a fluid passage for exhaust air from aperture 98 (FIG. 8) to flow through aperture 104 (FIG. 8), past valve body 42 (FIG. 3), and into exhaust aperture 30 (FIG. 3). Annular groove 126 receives o-ring seal 50 (FIG. 3).

Figure 17:
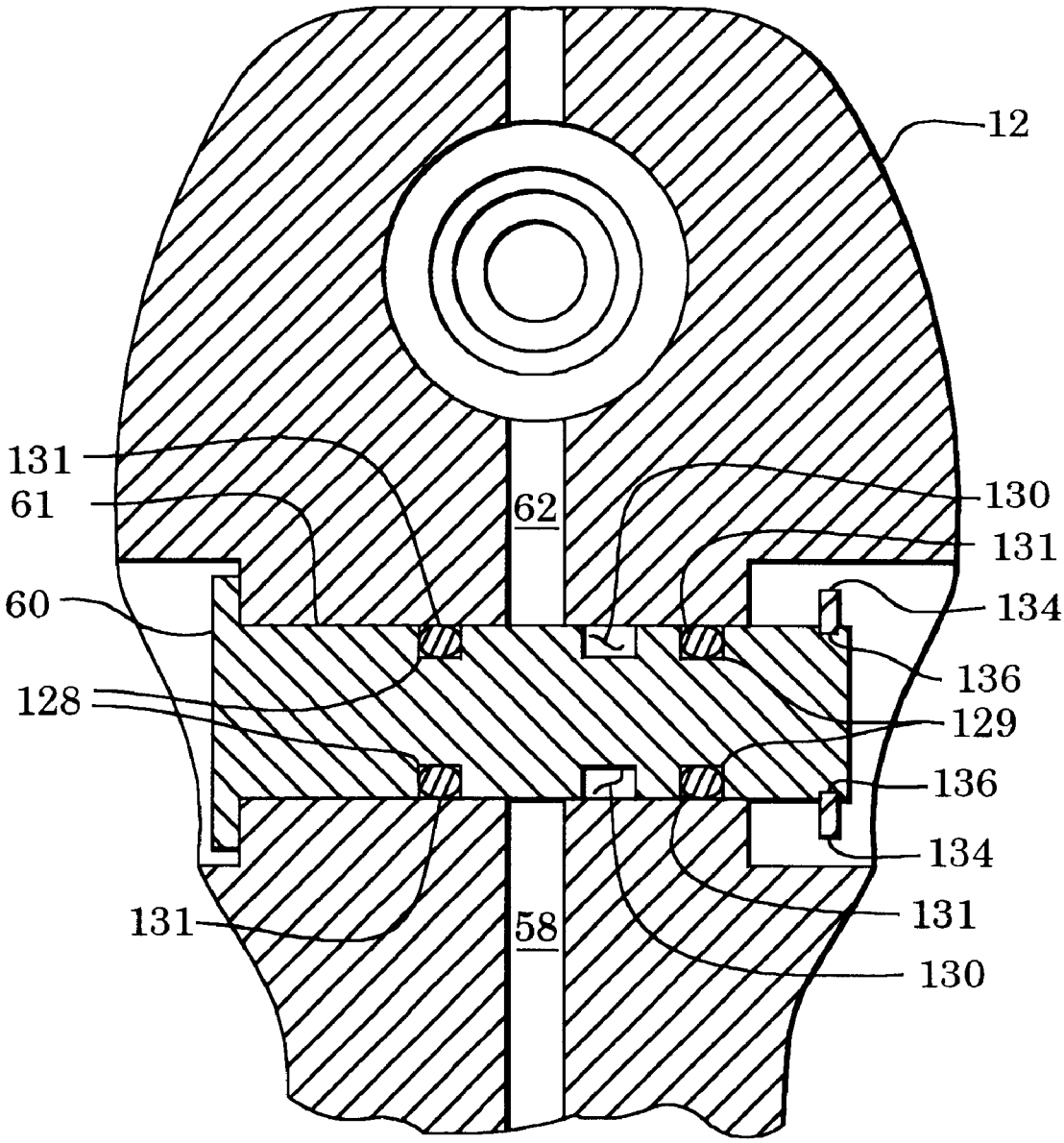
FIG. 17 is a partial cross-sectional view of body 12 depicting valve 60.

Referring now to FIG. 17, a partial cross-sectional view of body 12 is shown. In this view, the details of motor valve 6.0 are shown. Valve 60 is disposed in a through-hole 61 machined or formed in body 12. Valve 60 has a very small clearance with hole 61. Valve 60 includes three annular grooves 128, 129 and 130. Grooves 128 and 129 receive o-ring seals 131 therein. Groove 130 provides a fluid passage around valve 60 so that compressed air will flow from aperture 58 to aperture 62 when valve 60 is repositioned horizontally so that groove 130 is aligned with apertures 58 and 62. In the position shown, valve 60 prevents compressed air from passing between aperture 58 and aperture 62. C-clip 134 is attached as shown in groove 136 formed in valve 60 to prevent removal of valve 60 from within aperture 61.

While the invention has been illustrated and described in detail in the drawings and foregoing description of the preferred embodiment, the same is to be considered as illustrative and not restrictive in character, it being understood that only the preferred embodiment has been shown and described and that all changes and modifications that come within the spirit of the invention are desired to be protected.

What is claimed is:

1. An air blast tool having an integral light source comprising:

a body having an inlet aperture; a first outlet aperture and a second outlet aperture and wherein said first outlet aperture and said second outlet aperture are in fluid communication with said inlet aperture;

first valve means partially disposed within said first outlet aperture for controlling air flow,therethrough;

an air powered electrical generator having a rotor and a stator, said air powered generator being disposed within said second outlet aperture, said air powered electrical generator producing an electrical signal in response to pressurized air supplied from said inlet aperture to said second outlet aperture;

an electric light attached to said body and receiving said electrical signal to illuminate said electrical light; and air nozzle means attached to said body and disposed over said first outlet aperture.

2. The device of claim 1 including:

flow control means having a portion disposed within said second outlet aperture for variably metering air flow therethrough.

3. The device of claim 2 including second valve means having a portion disposed in said second outlet aperture, said second valve means fully restricting air flow in said second outlet aperture when activated and opening said second outlet aperture when deactivated.

4. The device of claim 3 wherein said second valve means is a shut-off valve.

5. An air blast tool having an integral light source and comprising:

a body having an inlet aperture, a first outlet aperture, a second outlet aperture, a first fluid passage communicating between said inlet aperture and said first outlet aperture, a valve aperture in fluid communication with said first fluid passage, and a second fluid passage communicating between said inlet aperture and said second outlet aperture;

first valve means disposed in said valve aperture and extending into, said first fluid passage for controlling air flow within said first fluid passage, said first valve means including mechanical actuator means for controlling said first valve means and enabling and disabling air flow in said first fluid passage;

an air powered electrical generator having a rotor and a stator, said air powered generator being disposed within said second fluid passage, said air powered electrical generator producing an electrical signal in response to air flowing through said second fluid passage;

an electric light attached to said body and receiving said electrical signal to illuminate said electrical light; and a hollow cylindrical member having a first end and a second end and wherein said first end is attached to said body, and disposed over said first outlet aperture.

6. The device of claim 5 wherein said body further includes a flow control aperture in fluid communication with said second fluid passage, said device further including a flow control member disposed in said flow control aperture and extending into said second fluid passage and partially obstructing said second. fluid passage.

7. The device of claim 6 wherein said flow control member is positionable within said flow control aperture to variably obstruct fluid flow in said second fluid passage.

8. The device of claim 7 wherein said body includes a shut-off aperture in fluid communication with said second fluid passage, said device further including a shut-off member disposed in said shut-off aperture extending into said second fluid passage, and wherein said shut-off member is positionable in a first position to fully obscure fluid flow in said second fluid passage, said shut-off member being positionable in a second position to allow fluid flow through said second fluid dosage.

9. The device of claim 8 wherein said electric light is positioned in close proximity to said second end of said hollow cylindrical member.

10. The device of claim 9 including means for attaching said inlet aperture to a source of compressed gas, said means for attaching being disposed in said inlet aperture.

11. The device of claim 10 wherein said body includes means for removably mounting said body to an external device.

12. The device of claim 11 wherein said means for removably mounting is a protrusion extending outward from and back towards said body at the distal end of said protrusion.

* * * * *